United States Patent [19]

Pearson et al.

[11] Patent Number: 4,798,366

[45] Date of Patent: Jan. 17, 1989

[54] SHAKE NAIL PULLER

[76] Inventors: Victor I. Pearson; George Spector, both of 233 Broadway, RM 3615, New York, N.Y. 10007

[21] Appl. No.: 671,088

[22] Filed: Nov. 13, 1984

[51] Int. Cl.[4] ..... B25C 11/00

[52] U.S. Cl. ..... 254/22

[58] Field of Search ..... 254/22, 25; 269/249

[56] References Cited

U.S. PATENT DOCUMENTS

| | | | |
|---|---|---|---|
| 903,928 | 11/1908 | Werd et al. | 254/22 |
| 1,640,883 | 8/1927 | Coleman | 269/238 |
| 2,614,894 | 10/1952 | Brock | 269/71 X |
| 4,097,021 | 6/1978 | Loboda | 254/22 |
| 4,105,344 | 8/1978 | Rousom | 269/249 |

FOREIGN PATENT DOCUMENTS

| | | | |
|---|---|---|---|
| 118934 | 5/1947 | Sweden | 254/22 |

*Primary Examiner*—Frederick R. Schmidt
*Assistant Examiner*—Judy J. Hartman

[57] ABSTRACT

A nail puller pliers provided with a fulcrum lever that is adjustable to the contour of the surface on which it rests. One embodiment has a resilient pad mounted to the free end of the fulcrum lever. Another embodiment has the pad mounted to the free end of the fulcrum lever by use of a ball and socket joint. A further embodiment has a resilient foot threadably mounted to the pad disposed on the free end of the fulcrum lever. A final embodiment has the fulcrum lever pivotally mounted to the second end of the second arm.

3 Claims, 1 Drawing Sheet

SHAKE NAIL PULLER

BACKGROUND OF THE INVENTION

The present invention relates to a nail puller plier. More particularly, it relates to a nail puller plier that has a fulcrum lever.

Nail puller pliers of the above mentioned general type are known in the art. fore example, U.S. Pat. No. 1,891,164 to Kluglein teaches a tack extractor in the shape of pliers with pulling jaws and a laterally extending brace used as a fulcrum. Another example, U.S. Pat. No. 145,830 to Baker et al teaches a tool that combines a nail extractor, a hammer, pliers and nail claw and contains a lever which acts as a fulcrum. A final example, U.S. Pat. No. 2,070,2176 Seger teaches a tool having a projecting portion which serves as a fulcrum about which the device may be rocked.

The nail puller pliers of the prior art contain the disadvantage that their fulcrum levers are not adjustable to the contour of the surface on which they rest.

SUMMARY OF THE INVENTION

Accordingly, it is an object of the present invention to provide a nail puller pliers which avoids the disadvantages of the prior art.

Another object of the present invention is to provide a nail puller pliers having a fulcrum lever which is adjustable to the contour of the surface on which it rests.

Yet another object of the present invention is to provide a nail puller pliers which has a resilient pad mounted on the free end of the fulcrum lever which can displace up and down and rotate in a ball and socket joint.

Still another object of the present invention is to provide a nail puller pliers in which the fulcrum lever is pivotly mounted to the second end of the second arm.

Further objects of the invention will appear as the description proceeds.

To the accomplishment of the above and related objects, this invention may be embodied in the form illustrated in the accompanying drawings, attention being called to the fact, however that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2:
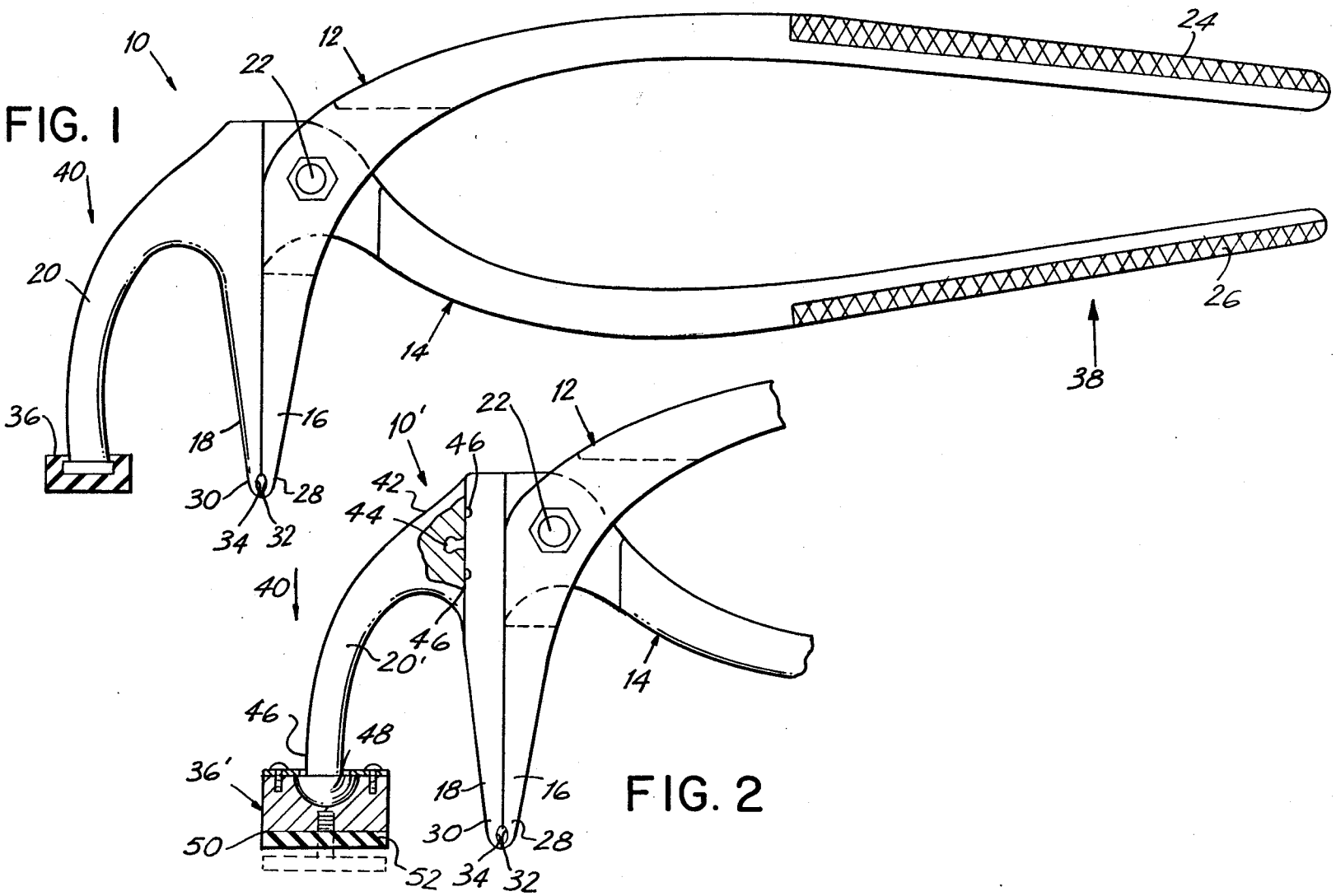
FIG. 1 is a side view of the invention with the foot pad in section.
FIG. 2 is a partial side view of a modification showing the fulcrum lever having a rotatable joint and the foot being adjustable for various situtations encountered by the puller.

Referring now to FIG. 1, the nail puller is shown generally at 10 having a first arm 12 and a second arm 14. The first arm 12 is found at one end with a first jaw 16. The second arm 14 is formed at one end with a second jaw 18 and a fulcrum lever 20. The first arm 12 and the second arm 14 are pivotaly mounted to each other at a pivot point 22.

The other ends of the first arm 12 and the second arm 14 are formed as handles 24 and 26, respectively, for gripping by the user. Free ends 28 and 30 of the first jaw 16 and the second jaw 18, respectively, are formed with recesses 32 and 34, respectively, which grip the nail head of the nail to be pulled. The fulcrum lever 20 has a free end onto which is attached a removably mounted pad 36. The pad 36 may be made out of a resilient material so as to conform to the contour of the area to which the fulcrum lever 20 is applied.

In operation the first and second jaws 16 and 18, respectively, are opened and closed around the nail so that the nail head is seated in the recesses 32 and 34. The pad 36 of the fulcrum lever 20 is rested on a supporting area. The user grips the handles 24 and 26 and exerts a force in the direction of arrow 38, pulling up the nail. While the force is applied in the direction of the arrow 38, a force ia applied on the fulcrum lever 20, in the direction of arrow 40, and thus assisting in the removal of the nail.

In FIG. 2, an alternate embodiment of the nail puller is shown generally at 10'. Parts that are identical to the embodiment shown in FIG. 1 will be designated by similar numbers. The fulcrum lever 20' is pivotally mounted at a first end 42 to the second arm 14 on a pivot pin 44. Surrounding the pivot pin 44 are snap locks 46 which lock the fulcrum lever 20' in a number of positions as it pivots laterally. At a free end 46 of the fulcrum lever 20', a pad 36' is mounted by means of a ball and socket joint 48. On a lower end 50 of the pad 36', a foot 52, is threadably mounted and is displaceable in an up and down direction.

What is claimed is:

1. A nail puller pliers comprising:

(a) a first arm having a first end formed with a handle and a second end formed with a first jaw having a free end;

(b) a second arm having a first end formed with a handle and a second end formed with a second jaw having a free end;

(c) a fulcrum lever mounted on said second end of said second arm having a free end;

(d) a resilient pad mounted to said free end of said fulcrum lever;

(e) a pivotal connection between said first and second arms providing a first axis for rotating said jaws towards and away from each other, wherein said lever is mounted rotatably about an axis perpendicular to the first said axis whereby said lever is moveable to transverse displaced positions parallel to said first axis including further means to lock said fulcrum lever in any one of said displaced positions whereby said pad can be located at various positions parallel to said first axis.

2. A nail puller as in claim 1, further comprising a foot adjustably mounted on said pad whereby said foot can be vertically adjusted.

3. A nail puller as in claim 2, further including means to releaseably lock said lever in various transverse positions.

* * * * *